United States Patent [19]

Kircher

[11] 3,979,061

[45] Sept. 7, 1976

[54] METHOD AND APPARATUS FOR MAKING ARTIFICIAL SNOW

[76] Inventor: Everett F. Kircher, P.O. Box 32, Boyne Falls, Mich. 49713

[22] Filed: Feb. 4, 1974

[21] Appl. No.: 439,574

[52] U.S. Cl. ..... 239/2 S; 239/14

[51] Int. Cl.[2] ..... F25C 3/04

[58] Field of Search ..... 239/2 S, 14, 77, 113

[56] References Cited

UNITED STATES PATENTS

| | | | |
|---|---|---|---|
| 1,469,465 | 10/1923 | Velton | 239/113 |
| 2,676,471 | 4/1954 | Pierce, Jr. | 239/2 S |
| 2,968,164 | 1/1961 | Hanson | 239/2 S |
| 3,567,117 | 3/1971 | Eustis | 239/2 S |
| 3,596,476 | 8/1971 | Jakob | 239/2 S |
| 3,703,991 | 11/1972 | Eustis et al. | 239/2 S |
| 3,822,825 | 7/1974 | Dupre | 239/14 |

*Primary Examiner*—John J. Love

*Attorney, Agent, or Firm*—Barnes, Kisselle, Raisch & Choate

[57] ABSTRACT

A method and apparatus for making and depositing artificial snow in which there is to be provided about a unidirectional, high volume movement of air at atmospheric pressure, coaxially therewith, a first plurality of nozzles each providing a high-velocity water spray directed at a first angle into the high volume air movement, and a second plurality of nozzles each spaced radially outwardly from a corresponding water nozzle and each providing a flat stream of compressed air directed into the high volume air movement at a second angle with respect thereto. The compressed air stream intersects the water spray at a point remote from the respective nozzles, preferably at the outer boundary of the high volume air movement. The flow from each water and compressed air nozzle is individually adjustable. Seeding means, including an adjustable duck-bill nozzle, may be provided to inject seed crystals into the high volume movement.

26 Claims, 10 Drawing Figures

NORMAL OPERATION

BLOW-OUT OF WATER NOZZLES AND MANIFOLD

BLOW-OUT OF A SINGLE NOZZLE

DUAL WATER SPRAYS

METHOD AND APPARATUS FOR MAKING ARTIFICIAL SNOW

This invention relates to artificial snow-making methods and machines of the type in which a water spray is directed into a high volume, unidirectional movement of air at atmospheric pressure causing crystalization of the spray droplets and deposition of the crystals as artificial snow.

The recent increase in interest in winter sports such as skiing and tobogganing has resulted in a corresponding increase in activity in the art of artificial snow-making devices. Until rather recently the vast majority of ski resorts equipped to make artificial snow have relied heavily on an early commercial unit similar to that shown in the U.S. Pat. No. 2,676,471, to Pierce. However, the Pierce machine, which mixes compressed air with water within a spray nozzle, was highly susceptible to nozzle clogging. Furthermore, the Pierce unit depended upon the force of the compressed air to move the crystalized snow beyond the immediate area of the nozzle. The volume of compressed air required per unit volume of deposited snow was therefore quite high, resulting in poor energy utilization.

In the last few years a new type of snow-making device has become commercially available which includes a high-powered fan for providing a substantially unidirectional high volume movement of air, and means outside of the fan cowling providing water spray to be injected into the high volume movement at a rate and in a quantity sufficient to cause crystalization of the spray and deposition of the crystals as artificial snow. Such a device is shown in the U.S. Pat. No. 2,968,164, to Hanson.

One such recent commercially available snow machine utilizing the principles of the Hanson patent is constructed pursuant to the U.S. Pat. No. 3,567,117, to Eustis et al, i.e. a large fan is employed to move the crystalized snow beyond the area of the nozzle. However, compressed air and water are still mixed within one seeding nozzle and water is added to the fan-moved air by a second exterior nozzle. The seeding nozzles are disposed within the protective cowling of the fan, thereby resulting in additional difficulties in repairing clogged nozzles. Furthermore, the mixing of compressed air and water within the confines of the nozzle results in inefficient use and waste of compressed air, with the attendant large expenditures required for power and equipment.

Accordingly, it is an object of the present invention to provide a method and apparatus which is an improvement upon such Hansen-type methods and apparatus for making and depositing artificial snow in greater quantity than such prior methods and machines without a corresponding sacrifice in crystal quality.

Another object of the present invention is to provide a method and apparatus for making and depositing artificial snow at a lower cost per unit volume as compared to the methods and machines presently available.

It is a further object of the present invention to provide a method and apparatus for making and depositing artificial snow which will yield high quality snow at an ambient air temperature approaching 32°F., and which provides improved flexibility in matching air and water input to varying ambient conditions.

It is yet a further object of the present invention to provide a method and apparatus for making and depositing artificial snow in which the water system may be dried when the apparatus is shut down.

These and other objects set forth hereinafter are achieved by providing a method and apparatus for making and depositing artificial snow in which a high velocity water spray and a high velocity air stream are directed into a large volume air movement at first and second angles with respect to the direction of movement thereof. The high velocity air stream intersects the water spray at a point remote from their respective nozzles to thereby achieve maximum dispersion of water particles throughout the unidirectional movement per unit volume of compressed air.

An increased volume of high quality snow may be achieved by providing a plurality of water and air nozzles about the periphery of the high volume movement, the respective nozzles being so disposed that each water spray is intersected and scattered by a high velocity air stream at the outer boundary of the movement. To achieve maximum scattering of spray particles, the several high velocity air nozzles may be spaced radially outwardly from the water spray nozzles so that the high velocity air streams intersect the water sprays at an angle tending to force the spray particles into the center of the high volume movement.

Pursuant to the present invention, means may be provided to "blow out" and dry the water system. Such blow out means includes means directly connecting the air nozzle to the water nozzle such that a high velocity stream of compressed air is diverted from the air nozzle into the water nozzle and water system, thereby driving the water from the system and preparing the water system for dry shut-down.

The novel features which are considered characteristic of the present invention are set forth in particular in the appended claims. The invention itself, however, together with additional objects, features and advantages thereof, will be best understood from the following description when read in conjunction with the accompanying drawings in which:

In the various views identical reference numerals indicate identical parts.

Figure 1:
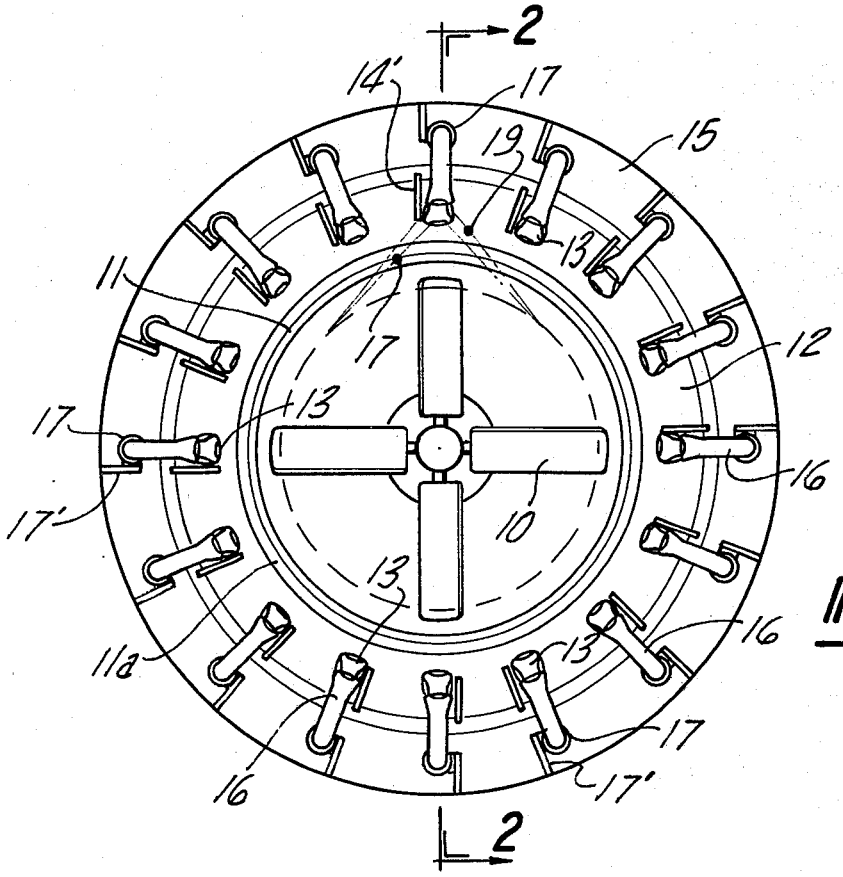
FIG. 1 is a semi-schematic front elevational view of one exemplary but preferred embodiment of the apparatus for making and depositing snow provided by the present invention pursuant to the method of the invention.
Figure 2:
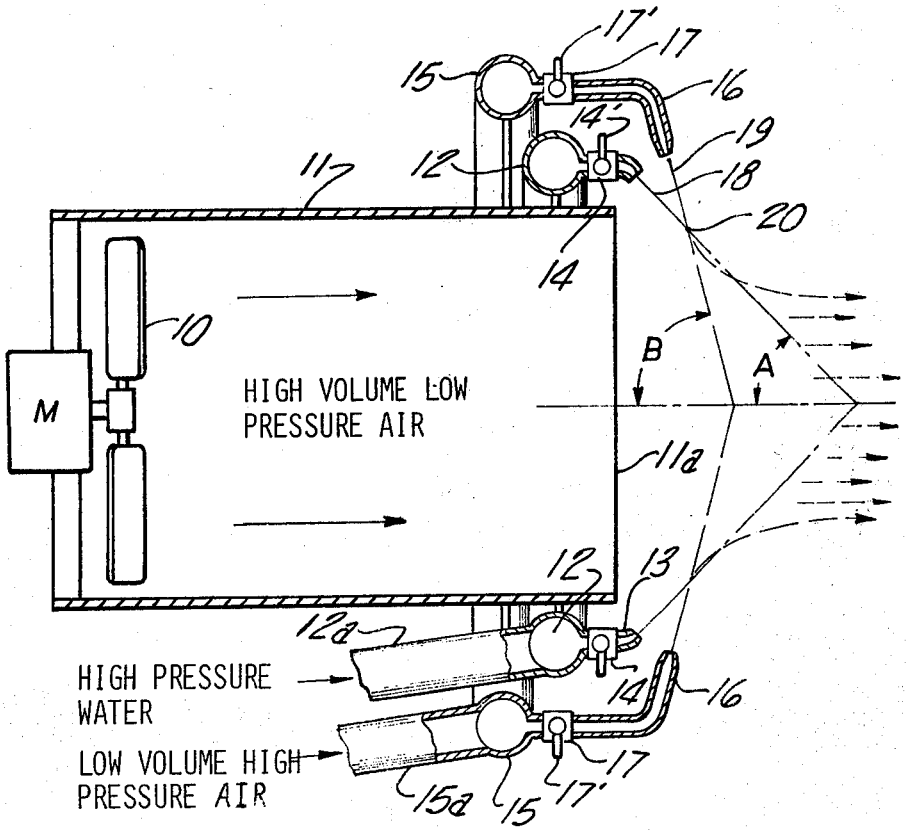
FIG. 2 is a sectional view of the apparatus shown in FIG. 1 taken along the line 2—2 of FIG. 1.

The description of the method and the basic apparatus provided by the present invention may be best understood by reference to FIGS. 1 and 2 wherein a power driven propeller 10 provides a substantially unidirectional large volume movement of air at atmospheric pressure. In one working mode of the invention, an orchard-spraying device manufactured by John Bean Division of FMC Corporation, Lansing, Michigan and sold under the trademark ROTOCAST was utilized to supply such components as the base, gasoline engine, power source and drive train (not shown) as well as propeller 10 and an associated shroud or bonnnet cowling 11 of the apparatus of the invention. Such apparatus may be mounted on the back of a flat-bed truck, snow track vehicle or bogie trailer and easily transported about the ski slopes.

The large volume unidirectional movement of air supplied by propeller 10 is directed through bonnet 11 into the atmosphere at essentially atmospheric pressure, i.e., although slightly compressed by the force of the propeller while confined laterally by bonnet 11, it is unconfined once it leaves the bonnet and hence it flows through the surrounding atmosphere primarily due to the momentum imparted to the air particles by propeller 10 and only secondarily due to pressure drop or molecular expansion. Circumferentially surrounding bonnet 11 and mounted thereon in proximity to the exit end 11*a* thereof is an annular water manifold 12 which is connected via water line 12*a* with a suitable source of water at a pressure preferably in the range of 250 to 300 psig. Manifold 12 supports a plurality of nozzles 13 each individually connected in fluid communication with manifold 12 and each oriented to provide a water spray 18 into the unidirectional movement at a first angle A with respect to the direction of movement thereof. Water spray nozzles 13 are preferably of the known helical or corkscrew type which produce a uniform dispersion of water droplets throughout a generally conical spray pattern. The water flow through each nozzle 13 is individually adjustable by hand manipulating the external arm 14' of a throttle valve 14.

Concentric with water manifold 12 but of larger overall diameter is an annular compressed-air manifold 15 which is connected via compressed air line 15*a* to a suitable source of compressed air at a pressure preferably in the range of 80 to 90 psig. A second plurality of nozzles 16 are mounted on and connected in fluid communication on manifold 15 such that each nozzle 16 provides a high velocity air stream 19 directed into the unidirectional movement at a second angle B with respect to the direction of movement thereof. The air flow through each nozzle 16 is individually adjustable by hand manipulating the external arm 17' of a throttle valve 17.

Air nozzle 16 is positioned radially outwardly from water nozzle 13 and oriented with respect thereto such that air stream 19 intersects water spray 18 at a point 20 remote from the air and water nozzles 16 and 13. In this configuration, high velocity air stream 19 is made to serve two functions: First, angular, unconfined intersection of air stream 19 with water spray 18 tends to scatter the water spray droplets toward the center of the high volume unidirectional air movement, thereby gaining a higher yield of artificial snow per unit volume of air moved. Secondly, intersection of stream 19 with the spray 18 while the compressed air is entirely unconfined and hence rapidly expanding extracts heat from the water droplets which promotes crystalization of some of the water spray droplets into ice particles, thereby "seeding" the large volume air movement and enhancing crystalization of the remaining spray droplets. Thus, the use of individual spray and air nozzles oriented as shown in FIGS. 1 and 2 achieves a greater snow making efficiency than apparatus presently known to the art.

Furthermore, this increase in efficiency is achieved at a reduced cost and without any sacrifice in snow quality. By way of example, the above-mentioned working model requires only about 10 per cent of the compressed air used by a commercial apparatus similar to that shown in the U.S. Pat. No. 2,676,471 to Pierce to produce the same quantity of artificial snow. This reduced compressed-air requirement translates into a reduction in the power requirements and thus more efficient utilization of energy, and in the size and number of air compressors and associated equipment and personnel required to provide snow for a given ski slope.

In this working model, which has been successfully operated on the ski slopes of Boyne Mountain Ski Lodge in Boyne Falls, Michigan, the water in manifold 12 was supplied at 250 to 300 pounds per square inch at a rate of about 200 gallons per minute. The compressed air in manifold 15 was supplied at 80 to 90 pounds per square inch at a rate of about 200 cubic feet per minute. It has been found that maximum efficiency is achieved when water spray 18 from nozzle 13 intersects air stream 19 from nozzle 16 at the outer boundary of the unidirectional large volume air movement approximately 3 inches from the respective nozzles. Intersection point 20 is so depicted in FIG. 2. At this point, angle A is approximately 45° and angle B is between 70° and 90°, preferably approximately 80°. This model has produced high quality snow at ambient air temperatures approaching 32°F.

To demonstrate the increased snow making capacity of the method and apparatus provided by the present invention the following statistics are given by way of example. In the above mentioned working embodiment which uses a John Bean orchard sprayer sold under the trademark ROTOCAST to produce a large volume air movement of 28,000 cubic feet per minute, 16 air nozzles 16 circumferentially disposed about the movement at intervals of 23° deliver 10 to 25 cubic feet per minute of compressed air at a manifold pressure to 70 to 100 pounds per square inch into the movement at an angle of 75° from a distance of 3 inches from intersection point 20. Similarly, 16 water nozzles 13 disposed about the movement at intervals of 23° deliver up to 300 gallons of water per minute at a manifold pressure of up to 400 pounds per square inch into the movement at an angle of 45° with respect to the direction of movement thereof from a distance of 3 inches from intersection point 20 at the boundary of the air movement. At an ambient temperature of 18°F. and a relative humidity of about 70% this embodiment produces high crystal quality snow consuming water at the rate of over 100 gallons per minute.

Figure 3:
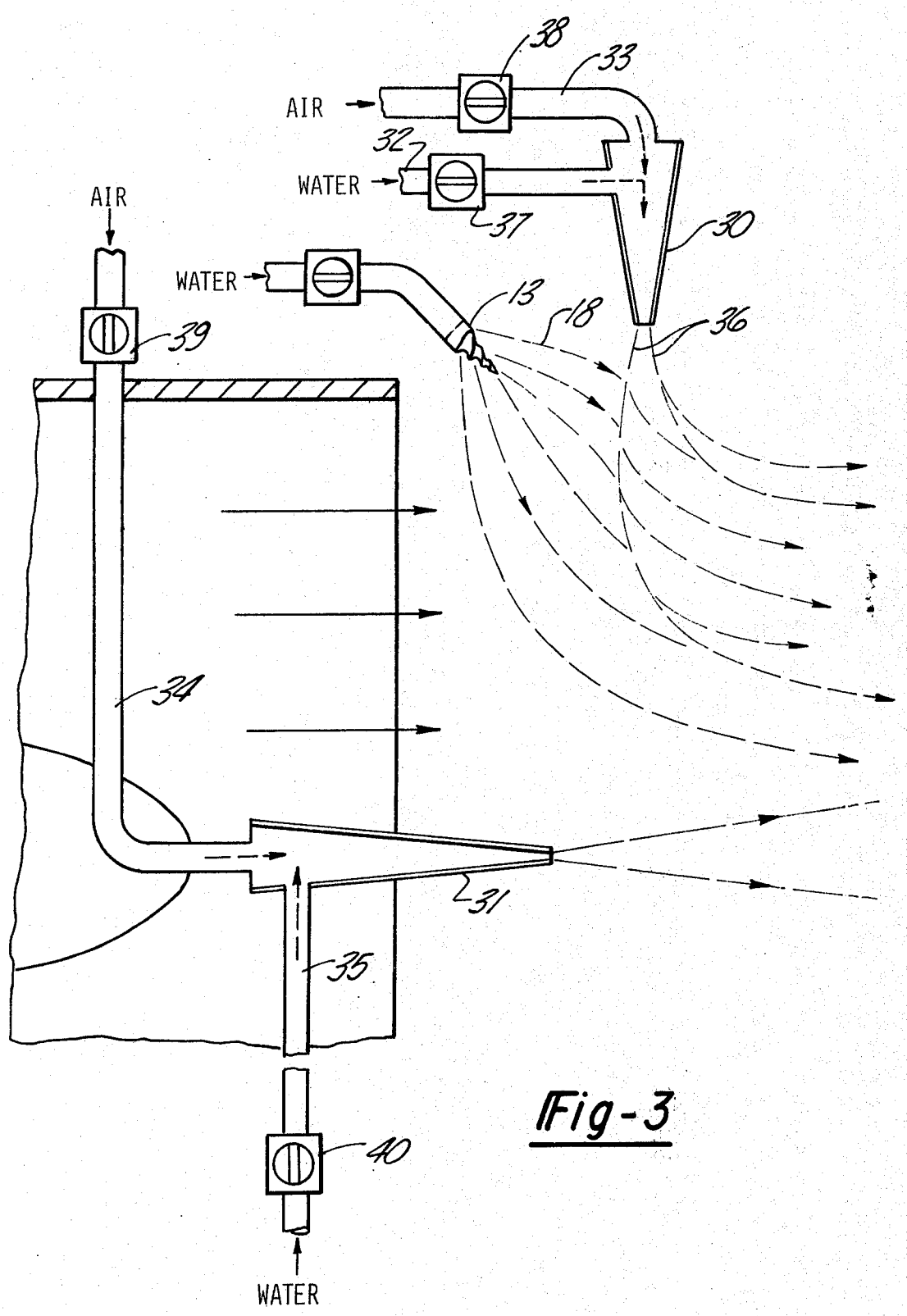
FIG. 3 is a semi-schematic fragmentary sectional view similar to that of FIG. 2 depicting a modification to the apparatus shown in FIG. 2.

In another embodiment of the invention shown in FIG. 3, seed crystals are directly added to the high velocity air stream by means of a nozzle 30 and to the unidirectional air movement by means of a nozzle 31. A high velocity water stream is directed by the duct 32 to intersect within nozzle 30 a high velocity air stream entering nozzle 30 via a duct 33. The water and air flows in ducts 32 and 33 are separately adjustable by means of hand-operated throttle valves 37 and 38 respectively so that the stream 36 which exits nozzle 30 contains not only a high velocity air stream to intersect and disperse the water droplets in spray 18 and crystalize some of these droplets in the manner set forth above, but also seed crystals to be injected into the unidirectional low pressure, high volume air movement. It has been found that maximum crystalization efficiency within nozzle 30 is obtained when the water stream from duct 32 intersects the air stream from duct 33 within the nozzle at an angle of 90° as shown. Each of the water nozzles 13 may have a seeding and dispersing nozzle 30 associated therewith, althrough fewer of the nozzles 30 may be provided if desired.

The interior seeding nozzle 31 may be provided in addition to nozzle(s) 30, and operates in a similar manner. A high velocity air stream supplied via a conduit 34 intersects within nozzle 31 at an angle of 90°, a high velocity water stream exiting from conduit 35, thereby creating a mixture which is directed into the large volume air movement by means of nozzle 31 and crystalized at the exit throat thereof. Conduits 34 and 35 are provided with hand-operated throttle valves 39 and 40 respectively which may be adjusted to provide maximum seeding efficiency.

By adjusting the ratio of the compressed air an pressurized water fed to seeding and air-spray nozzle 30 and seeding nozzle 31, optimum results may be readily obtained under varying ambient conditions. For example, at temperatures approaching 30°F. wet bulb the seeding nozzle feed is preferably "leaned out", thereby creating small seed crystals or "smoke".

Figure 4:
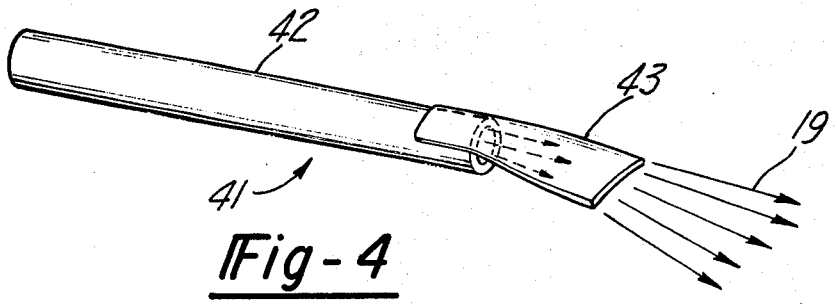
FIG. 4 is a perspective view of a compressed air nozzle which may be used in the apparatus provided by the present invention.

As indicated above in the discussion relative to FIGS. 1 and 2, the purpose of air stream 19 emitted from nozzle 16 is twofold: to disperse and direct spray 18 from nozzle 13 and to crystalize some of the water spray droplets. Maximum dispersion efficiency is achieved when high velocity air stream 19 exiting nozzle 16 is substantially flat and co-extensive with the transverse dimension of the water spray 18 at the point 20 of intersection. The air stream may be "flattened out" by using either a conventional duck-bill nozzle or, alternatively, the nozzle 41 shown in FIG. 4. Nozzle 41 includes a hollow tube 42 through which compressed air flows from manifold 15, and a curved plate 43 disposed at the outlet end of tube 42 so as to extend into and deflect the air stream exiting from the outlet of tube 42 to thereby flatten stream 19 and to direct it into the unidirectional movement. Nozzle 41 achieves the same result as the conventional duck-bill nozzle in this application at a substantially reduced manufacturing cost, and is not liable to clogging.

Figure 5:
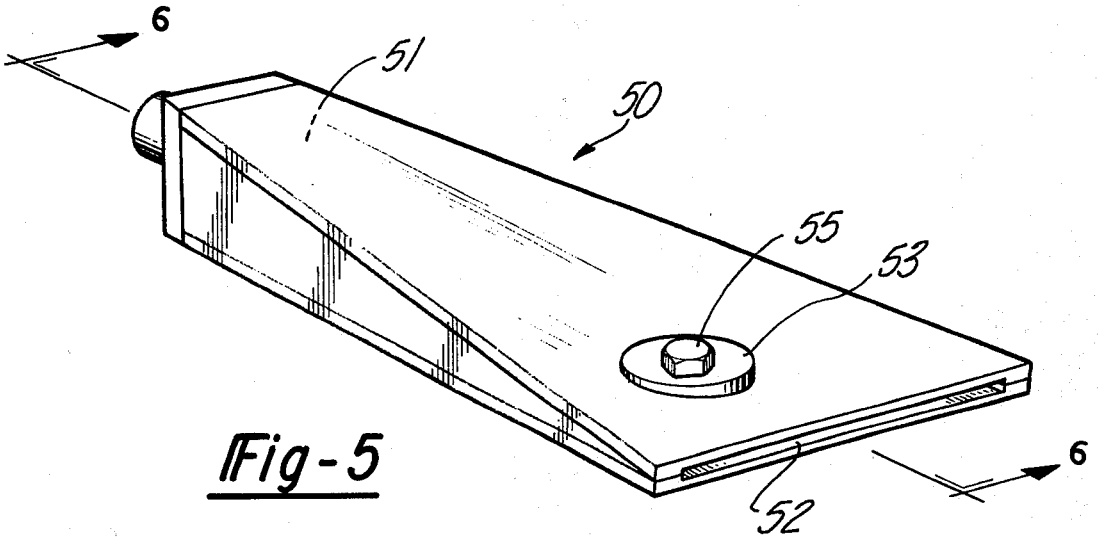
FIG. 5 is a perspective view of an adjustable duck-bill nozzle which may be used in the apparatus provided by the present invention.
Figure 6:
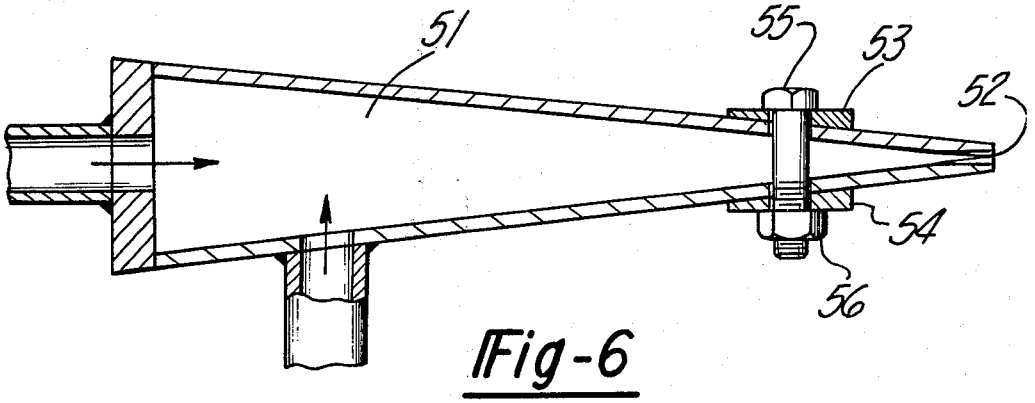
FIG. 6 is a sectional view longitudinally bisecting the adjustable duck-bill nozzle shown in FIG. 5.

Referring to FIGS. 5 and 6, an adjustable duck-bill nozzle 50 is shown which may be used in place of nozzle 31 of the embodiment shown in FIG. 3 to achieve greater versatility in the seeding operation. Nozzle 50 is generally in the nature of a conventional duck-bill nozzle in that it has an exit throat 52 which is long and thin in comparison to the entrance throat 51; however, nozzle 50 is also provided with means to adjustably pinch exit throat 52 and thereby restrict the flow therethrough. The adjustable means shown in FIGS. 5 and 6 comprises a screw 55 piercing nozzle 50 in proximity to throat 52, a pair of washers 53 and 54 encompassing the threaded shank of screw 55 on either side of nozzle 50, and a nut 56 threadably received on screw 55 to clamp the screw and washers and adjustably pinch throat 52.

The provision of the separate circumferential arrays of water nozzles 13 and air nozzles 16 oriented and arranged as described above results in many operating and maintenance advantages. The respective manifolds 12 and 15 may be directly connected to the high pressure water and compressed air supplies in a manner requiring a minimum number of fittings and lines. A wide variety of air and water spray combinations can be selected to best meet ambient conditions and the particular terrain upon which the artificial snow is being deposited. With the valves located externally of the cowling they are more readily accessible for operational adjustments as well as maintenance and repair. This factor is of particular significance when icing conditions develop in or about the valves or nozzles.

One important feature of the present invention is the mixture of the water spray with high pressure compressed air when both streams are in an unconfined state. This not only helps break up the water spray into finer particles, but also helps to better disperse the particles into and throughout the high volume movement of low pressure air while at the same time, through the refrigeration effect of the rapidly expanding unconfined compressed air, generating seeding particles at the point of intermixture of the water droplets of the air stream. Since, in the embodiment of FIG. 2, there is no intermixture of air and water either within the nozzles 13 or 16 or within the cowling 11, there is no chance for icing conditions to occur within any confined line, nozzle, passageway or the like. Hence the apparatus is relatively clog-free in operation.

It is to be understood that the provision of low volume, high pressure air nozzle 16 or 30 enables artificial snow to be made under adverse climatic conditions; i.e., when the dry bulb temperature is between 25° and 32°F. and the relative humidity between about 60 and 100 per cent. This result is believed to accrue from the combined action of the refrigerating and dispersing effect of the high velocity, high pressure air stream. Of course, when conditions are favorable for making artificial snow, as when the temperature and the humidity are low, and high pressure air can be shut off or cut down by reducing the number of nozzles 16 in operation and good quality snow will still result merely from the mixture of water spray 18 into the high volume low pressure main air stream. As conditions worsen for producing artificial snow, additional air jets 13 can be cut into operation by manipulation of handle 17' of valve 17 while the snow-making machine continues in operation.

Although the apparatus of the present invention thus requires a source of compressed air, this is not a significant limitation since almost all ski slopes presently equipped with the prior art type of artificial snowmaking equipment already have compressed air lines installed and associated air compressor equipment available. Hence, in most installations, no additional capital investment is required other than for the snowmaking machine itself. In addition, the required quantity of compressed air will be greatly reduced by the substitution of the apparatus of the invention for the prior art snowmaking devices while at the same time increasing the snowmaking capacity and enabling artificial snow to be made when it is most needed; i.e. under the aforementioned high temperature and humidity conditions which are often the most critical periods in terms of need for artificial snow.

The provision of a source of compressed air in the form of manifold 15 located closely adjacent water supply manifold 12, and the close proximity of each air nozzle 16 to associated water nozzle 13 results in yet another advantage of the present invention. With this relationship in mind, the modified valve arrangement shown in FIG. 7 may be installed in the apparatus provided by the present invention so that high velocity air diverted from nozzle 16 may be used to "blow out" nozzle 13 and manifold 12, preferably after the manifold 12 has been disconnected from the water source. An air three-way valve 70 disposed between nozzle 16 and manifold 15 is connected to the water spray system by means of a cross-over conduit 72 and a second three-way valve 74 is disposed between water spray nozzle 13 and manifold 12. In the configuration shown in FIG. 7 compressed air from manifold 15 enters valve 70 at the throat 76 and is fed to nozzle 16 by means of the throat 78 which, together, with throat 76, forms the "straight through" channel of three-way valve 70. A diverting throat 80 which taps the "straight through" channel defined by throats 76 and 78 at a right angle with respect thereto is blocked when valve 70 is in its "normal operation" position shown in FIG. 7. Similarly, water from manifold 12 is fed "straight through" to nozzle 13 by means of the throats 82 and 84 while a diverting throat 86 which taps the "straight through" channel of valve 74 at a right angle with respect thereto routes water from manifold 12 into conduit 72, which conduit is blocked at valve 70 in the normal operation mode. Thus, the arrangement of valves 70 and 74 as shown in FIG. 7 results in normal operation of the snow-making apparatus substantially as described above, i.e., the water diverted into conduit 72 by means of throat 86 is blocked at valve 70 and has no effect upon the system.

Figure 8:
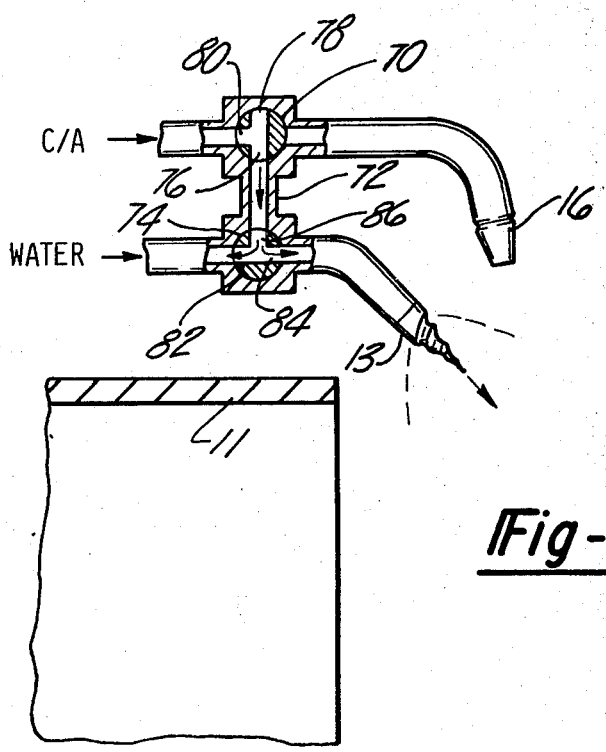
FIGS. 8–10 are semi-schematic fragmentary sectional views which depict alternative conditioning of the modified apparatus shown in FIG. 7 to accomplish blow out of water system, blow out of a selected water nozzle, and dual water spray through an associated air/water nozzle combination, respectively.

When the apparatus provided by the invention is to be shut down, valves 70 and 74 are rotated to their respective positions as shown in FIG. 8 to "blow out" the water system with compressed air and thus prevent freezing damage to the water pipes, manifold and nozzles. Before "blow out" is accomplished, the water system comprising manifold 12 and nozzles 13 is preferably disconnected from the water source at line 12*a* so that the water at the source will remain pure — i.e., free from compressed air. Furthermore, the water system should be disconnected from the source to prevent water from leaking back into the manifold or nozzles after "blow out" has been accomplished.

Figure 7:
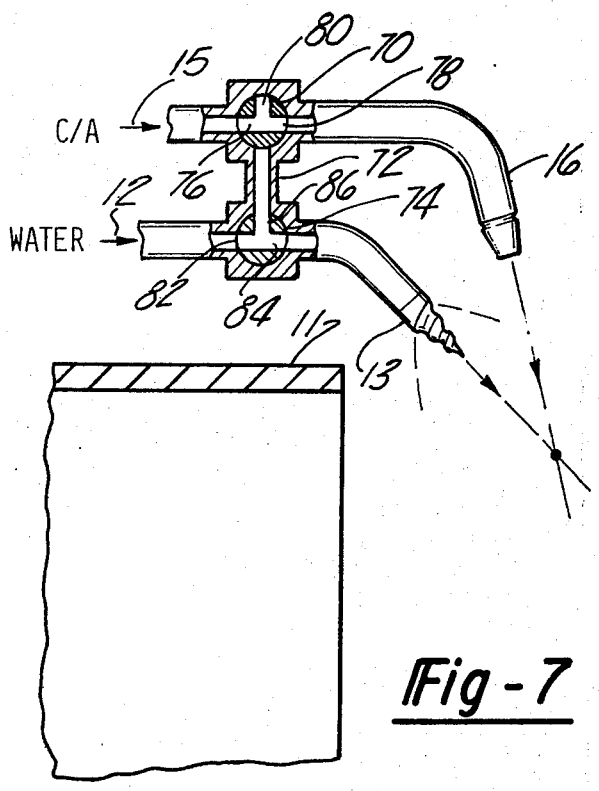
FIG. 7 is a semi-schematic fragmentary sectional view which depicts the normal operating configuration of a second modification to the apparatus shown in FIG. 2.

Referring to FIG. 8, the three-way throat means provided by valve 70 are shown at a position rotated 90° counterclockwise from the normal operating position shown in FIG. 7. In this position compressed air from manifold 15 passes through valve 70 and enters cross-over conduit 72 by way of diverting throat 80 and throat 76. Throat 78, which together with throat 76 forms the "straight through" channel of valve 70 is thus blocked so that the full force of the air in manifold 15 is presented to the water spray system by means of valve 70 and conduit 72. With valve 74 disposed in the same position as in the embodiment shown in FIG. 8, compressed air forces the water back out of conduit 72 and enters valve 74 at throat 86 to be thereafter diverted through throats 82 and 84 at flow rates inversely proportional to the back-pressures at throats 82 and 84 respectively.

With manifold 12 disconnected from the water source and with the inlet aperture 12*a* to the manifold thus open to drain, turning valve 70 to the blow out position will force water in both directions from its point of entry into valve 74 so as to blow water out the ends of nozzles 13 as well as to blow the water out manifold 12 via open inlet 12*a*. Thus, in a relatively short time, the water nozzles and the water manifold can be dried so that they do not freeze and clog during shutdown.

Figure 9:
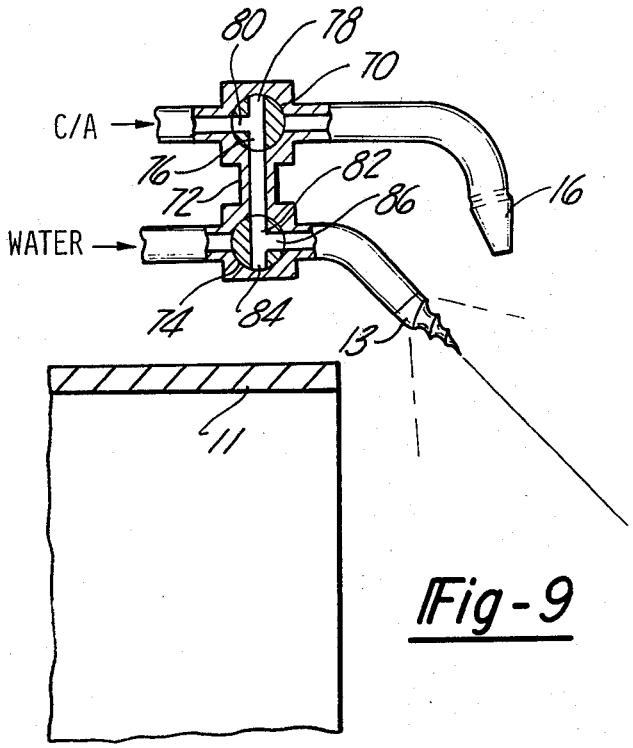

The versatile paired three-way valve arrangement shown in FIG. 7 may be used in the apparatus provided by the invention to accomplish results other than "blow out" of the water spray system as shown in FIG. 8. For example, during normal operation of the apparatus, valves 70 and 74 may be manipulated so as to blow out any nozzle 13 that may become clogged. Referring to FIG. 9, water valve 74 is first rotated to a position 90° clockwise from the normal operating position discussed with respect to FIG. 7. At this position water from manifold 12 blocked by valve 74 and cross-over conduit 72 is in communication with nozzle 13 by means of ports 82 and 86. Air valve 70 may be then rotated 90° counterclockwise from the normal operating position to the blow out position discussed above with reference to FIG. 8. Compressed air from manifold 15 will then enter valve 74 through valve 70 and conduit 72 and blow out the ice or debris which has clogged nozzle 13. Valves 70 and 74 may be then returned to their normal operating positions so that operation may continue substantially without interruption.

Another advantage of the paired three-way valving arrangement of FIGS. 7–9 is that it will enable high pressure water to be supplied to any selected number of air nozzles to convert them to water nozzles when conditions are very favorable to making snow; i.e., at very low temperature and humidity conditions when snow can be made with maximum discharge of water and a minimum amount of dispersion of water particles. This "supercharging" feature further augments the flexibility of the apparatus of the invention to meet a wide variety of snow-making conditions.

Figure 10:
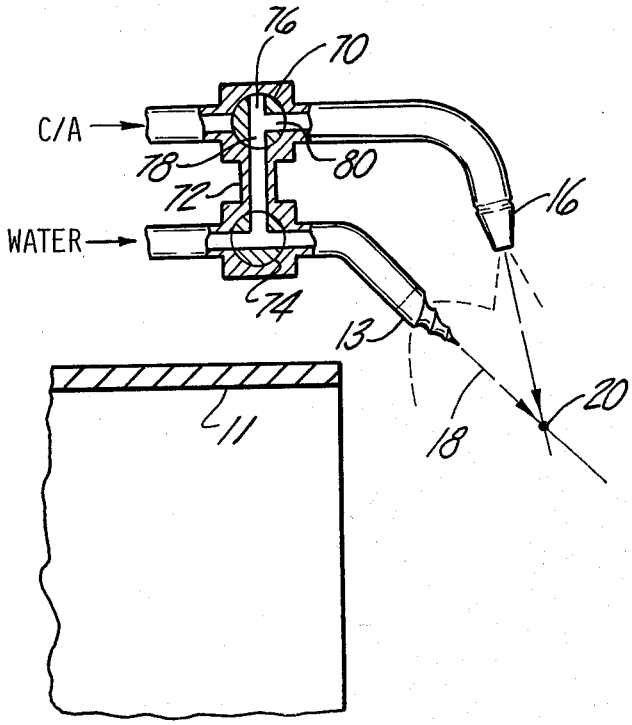

This "supercharging" configuration is shown in FIG. 10 wherein water three-way valve 74 remains in the normal operating position discussed above with reference to FIG. 7 but air three-way valve 70 is rotated 90° clockwise from the normal operating position so that the high pressure water in cross-over conduit 72 is fed to nozzle 16 by means of throats 78 and 80 and so that throat 76 is blocked. In this configuration water spray 18 exiting nozzle 12 and a secondary water spray 90 exiting nozzle 16 intersect at a point remote from the respective nozzles.

As detailed above, nozzles 16 and 13 are preferably disposed so that, during normal operation, air spray 19 and water spray 18 intersect at point 20 at the boundary of the unidirectional movement as the movement exits bonnet 11. During the "supercharging" operation, it is preferred to have the water pressure in manifold 12 sufficiently high so that water spray 18 and secondary spray 90 travel a substantially straight line to the point 20. In this manner, point 20 will again be at the boundary of the unidirectional movement. The water pressure range of 250 to 300 pounds per square inch mentioned above with respect the working model of the invention has been found to be sufficiently high to achieve this preferred result.

It will be recognized that, while the three-way valve arrangement discussed above with reference to FIGS. 7–10 are directed to air nozzles 16 and water nozzles 13 disposed vertically above the center line of the unidirectional air movement, the principles disclosed are equally applicable to nozzles disposed below the air movement.

From the foregoing description it will now be evident the method and apparatus for making and depositing artificial snow in accordance with the present invention fully satisfies the objects and advantages set forth above. While the invention has been described in conjunction with specific embodiments thereof, it is evident that many alternatives, modifications and variations will be apparent to those skilled in the art in light of the foregoing description. Accordingly, the invention is intended to embrace all such alternatives, modifications and variations as fall within the spirit and broad scope of the appended claims.

What is claimed is:

1. Apparatus for making and depositing artificial snow comprising, in combination, means providing a substantially unidirectional large volume movement of air in outside ambient air substantially at atmospheric pressure, first nozzle means disposed externally of said air movement and providing a high velocity water spray directed into said unidirectional air movement at a first angle with respect to the direction of movement thereof, and second nozzle means distinct from said first means disposed externally of said air movement and communicating with a source of compressed air providing a high velocity expanding air stream directed into said unidirectional movement at a second angle with respect to the direction of movement thereof, one of said nozzle means being disposed radially between the major central axis of said unidirectional air movement and the other of said nozzle means, said first and second nozzle means being oriented with respect to one another such that said air stream intersects said water spray at an unconfined point remote from said first and second nozzle means in the outside ambient air such that droplets in said water spray are driven into and substantially dispersed within said air movement by the conjoint action of the momentum of said water spray and the additional forces imparted thereto by said air stream, and at least a portion of said water droplets are frozen into seed crystals by the refrigerating action of said high velocity expanding air stream.

2. The apparatus set forth in claim 1 wherein said first nozzle means is radially disposed between the major central axis of said unidirectional air movement and said nozzle second means.

3. The apparatus set forth in claim 1 wherein said first nozzle means comprises a first plurality of water nozzles circumferentially disposed about said air movement means coaxially therewith, and said second nozzle means comprises a second plurality of air nozzles circumferentially disposed about said first nozzle means coaxially therewith and radially displaced therefrom.

4. The apparatus set forth in claim 3 wherein said first and second pluralities of nozzles are equal in number and disposed about said movement means such that each water nozzle is radially disposed between the central axis of said movement and a corresponding air nozzle.

5. The apparatus set forth in claim 4 further comprising first valve means connecting each of said first plurality of nozzles to a source of water, and second valve means connecting each of said water nozzles to said corresponding air nozzle.

6. The apparatus set forth in claim 3 wherein said first and second nozzle means further comprise means for individually adjusting the fluid flow through each of said first and second pluralities of nozzles.

7. The apparatus set forth in claim 4 wherein said first angle is inclined in the direction of said air movement at substantially 45° with respect to said axis and said second angle is between 70° and 90° with respect to said axis.

8. The apparatus set forth in claim 7 wherein said second angle is substantially 80°.

9. The apparatus set forth in claim 1 wherein said first and second means are so disposed with respect to said air movement means that said water spray and air stream intersect at the boundary of said air movement.

10. The apparatus set forth in claim 1 wherein said second nozzle means includes means providing a high velocity air stream which is substantially flat.

11. The apparatus set forth in claim 10 wherein said second nozzle means comprises a duck-bill nozzle.

12. The apparatus set forth in claim 10 wherein said second nozzle means comprises a hollow tubulation through which the air stream is to flow and means disposed at the end of said tubulation deflecting said air stream in the direction of said unidirectional movement.

13. The apparatus set forth in claim 1 further comprising, means connecting said first nozzle means to a source of water, and valve means connecting said first nozzle means to a source of compressed air, whereby the disconnecting of said connecting means and the opening of said valve means causes the residual water remaining in said first nozzle means to be blown therefrom.

14. The apparatus set forth in claim 13 wherein said source of compressed air comprises said second nozzle means.

15. The apparatus set forth in claim 14 wherein said first nozzle means comprises a water spray nozzle and wherein said connecting means comprises valve means connecting said nozzle to said source of water.

16. The apparatus set forth in claim 1 further comprising first valve means connecting said first nozzle means to a source of water when in a first position and blocking said connection when in a second position, second valve means connecting said second nozzle means to a source of compressed air when in a first position and blocking said connection when in a second position, and third valve means connecting said first and second nozzle means when in a first position and blocking said connection when in a second position.

17. The apparatus set forth in claim 16 wherein said first, second and third valve means comprise first three-way valve means connected between said first nozzle means and said source of water, second three-way valve means connected between said second nozzle means and said source of compressed air, and conduit means connecting said first and second three-way valve means.

18. The apparatus set forth in claim 1 wherein said first nozzle means comprises an annular water manifold circumferentially disposed about the central axis of said unidirectional movement, at least one water spray nozzle in fluid communication with said manifold, said nozzle being oriented to provide said water spray, means removably connecting said manifold to a source of water, and valve means connecting said manifold and said nozzle to a source of compressed air, whereby the removal of said connecting means and the opening of said valve means causes the residual water in said manifold and nozzle to be blown therefrom.

19. The apparatus set forth in claim 18 wherein said source of compressed air comprises said second nozzle means.

20. The method of making and depositing artificial snow comprising the steps of providing a large volume movement of air at atmospheric pressure having a temperature less than 32°F., directing a high velocity spray of water into said movement from a point externally thereof at a first angle with respect thereto, and directing a high velocity air stream into said movement from a point externally thereof at a second angle with respect thereto so as to impinge said water spray when both said air stream and said water spray are unconfined, such that droplets in said water spray are substantially dispersed within said air movement and at least some of said spray droplets are frozen by expansion of said air stream to form seed crystals.

21. In the method of making and depositing artificial snow wherein a high velocity spray of water is directed into a large volume movement of air at atmospheric pressure, the improvement comprising the step of directing a high velocity stream of air into said movement to intersect said water spray where both said spray and said stream are unconfined, such that droplets in said water spray are driven into and substantially dispersed within said air movement by the conjoint action of the momentum of said water spray and the additional forces imparted thereto by said air stream, and at least a portion of said water droplets are frozen into seed crystals by the refrigerating action of said high velocity expanding air stream.

22. The improved method set forth in claim 21 wherein said water spray and air stream intersect at the boundary of said large volume movement.

23. Apparatus for making and depositing artificial snow comprising, in combination, means providing a substantially unidirectional large volume movement of air at atmospheric pressure, first nozzle means providing a high velocity water spray directed into said unidirectional air movement at a first angle with respect to the direction of movement thereof, second nozzle means distinct from said first means providing a high velocity air stream directed into said unidirectional movement at a second angle with respect to the direction of movement thereof, said first and second nozzle means being oriented with respect to one another such that said air stream intersects said water spray at a point remote from said first and second nozzle means, first valve means connecting said first nozzle means to a source of water when in a first position and blocking said connection when in a second position, second valve means connecting said second nozzle means to a source of compressed air when in a first position and blocking said connection when in a second position, and third valve means connecting said first and second nozzle means when in a first position and blocking said connection when in a second position.

24. The apparatus set forth in claim 23 wherein said first, second and third valve means comprise first three-way valve means connected between said first nozzle means and said source of water, second three-way valve means connected between said second nozzle means and said source of compressed air, and conduit means connecting said first and second three-way valve means.

25. Apparatus for making and depositing artificial snow comprising, in combination, means providing a substantially unidirectional large volume movement or air at atmospheric pressure, first nozzle means providing a high velocity water spray directed into said unidirectional air movement at a first angle with respect to the direction of movement thereof, second nozzle means distinct from said first means providing a high velocity air stream directed into said unidirectional movement at a second angle with respect to the direction of movement thereof, said first and second nozzle means being oriented with respect to one another such that said air stream intersects said water spray at a point remote from said first and second nozzle means, said first nozzle means comprising an annular water manifold circumferentially disposed about the central axis of said unidirectional movement, at least one water spray nozzle in fluid communication with said manifold, said nozzle being oriented to provide said water spray, means removably connecting said manifold to a source of water, and valve means connecting said manifold and said nozzle to a source of compressed air, whereby the removal of said connecting means and the opening of said valve means causes the residual water in said manifold and nozzle to be blown therefrom.

26. The apparatus as set forth in claim 25 wherein said source of compressed air comprises said second nozzle means.

* * * * *